US009666985B2

(12) United States Patent
Bernardi et al.

(10) Patent No.: US 9,666,985 B2
(45) Date of Patent: May 30, 2017

(54) HIGH-SPEED ELECTRICAL CONNECTOR

(71) Applicant: AMPHENOL SOCAPEX S.A, Thyez (FR)

(72) Inventors: Christophe Bernardi, Sallanches (FR); Lionel Poujol, Vougy (FR); Gabriel Tupin, Vougy (FR)

(73) Assignee: AMPHENOL SOCAPEX S.A. (FR)

( * ) Notice: Subject to any disclaimer, the term of this patent is extended or adjusted under 35 U.S.C. 154(b) by 162 days.

(21) Appl. No.: 14/421,788

(22) PCT Filed: Aug. 13, 2013

(86) PCT No.: PCT/FR2013/051935

§ 371 (c)(1),
(2) Date: Feb. 13, 2015

(87) PCT Pub. No.: WO2014/027164

PCT Pub. Date: Feb. 20, 2014

(65) Prior Publication Data

US 2015/0311631 A1 Oct. 29, 2015

(30) Foreign Application Priority Data

Aug. 17, 2012 (FR) ..... 12 57852

(51) Int. Cl.

| | |
|---|---|
| ***H01R 24/00*** | (2011.01) |
| ***H01R 13/631*** | (2006.01) |
| ***H01R 13/6477*** | (2011.01) |
| ***H01R 24/44*** | (2011.01) |

(52) U.S. Cl.

CPC ..... *H01R 13/631* (2013.01); *H01R 13/6477* (2013.01); *H01R 24/44* (2013.01)

(58) Field of Classification Search

CPC ..... H01R 33/6951
USPC ..... 439/732, 281, 284, 935
See application file for complete search history.

(56) References Cited

U.S. PATENT DOCUMENTS

| | | | | |
|---|---|---|---|---|
| 1,157,026 | A * | 10/1915 | Meschenmoser | H01R 24/28 174/155 |
| 2,384,267 | A * | 9/1945 | Andersen | H01R 13/28 439/284 |
| 2,386,177 | A * | 10/1945 | Andersen | H01R 13/6275 439/293 |
| 3,309,632 | A | 3/1967 | Trudeau | |
| 3,643,210 | A * | 2/1972 | Fujita | H01R 13/514 439/687 |
| 3,742,424 | A * | 6/1973 | Startin | H01R 13/44 439/678 |
| 3,745,512 | A * | 7/1973 | Johnson | H01R 13/434 439/378 |

(Continued)

FOREIGN PATENT DOCUMENTS

| | | |
|---|---|---|
| GB | 574051 | 12/1945 |

OTHER PUBLICATIONS

International Search Report for WO 2014/027164 A1.

*Primary Examiner* — Neil Abrams
(74) *Attorney, Agent, or Firm* — Blank Rome LLP

(57) ABSTRACT

A high-speed electrical connector with constant characteristic impedance according to the invention has at least one pair of connection elements (15) installed in an insert (25) of insulating material, and the end portion of said insert is shaped so as to define a baffle (37) between the two connection elements (15).

7 Claims, 2 Drawing Sheets

(56) References Cited

U.S. PATENT DOCUMENTS 3,888,559 A * 6/1975 Geib ..... H01R 13/635 439/157
4,061,406 A * 12/1977 Kunkle ..... H01R 13/28 439/291
4,337,989 A * 7/1982 Asick ..... H01R 13/6595 174/359
4,455,056 A * 6/1984 Herrmann, Jr. ..... H01R 13/53 439/284
4,806,123 A * 2/1989 Konishi ..... H01R 13/4364 439/595
4,810,207 A * 3/1989 Butterfield ..... H02G 3/20 439/529
4,851,725 A * 7/1989 Keck ..... H02K 5/225 144/248.5
4,986,758 A * 1/1991 Wakata ..... H01R 13/4365 439/374
5,131,858 A * 7/1992 Heimbrock ..... H01R 13/53 439/181
5,173,062 A * 12/1992 Uchida ..... H01J 5/54 439/617
5,188,538 A * 2/1993 Joveux-Bouillon ... H01R 13/53 439/198
5,342,221 A * 8/1994 Peterson ..... H01R 13/64 439/677
5,487,680 A * 1/1996 Yamanashi ..... B60R 16/0222 439/34
5,662,500 A * 9/1997 Yeah ..... H01R 13/53 439/181
5,674,094 A * 10/1997 Hutchinson, Jr. .... H01R 12/716 439/680
5,703,324 A * 12/1997 Harder ..... H01R 24/28 174/21 C
5,769,648 A * 6/1998 Hayashi ..... H01R 13/5227 439/206
6,116,952 A * 9/2000 Nakata ..... H01R 13/5221 439/391
6,368,121 B1 * 4/2002 Ueno ..... H01R 13/6471 439/108
6,431,904 B1 * 8/2002 Berelsman ..... H01R 13/5845 439/344
6,478,585 B2 * 11/2002 Yuasa ..... H01R 9/2458 439/732
6,511,352 B2 * 1/2003 Suzuki ..... H01R 13/5219 439/271
6,776,663 B2 * 8/2004 Otremba ..... H01L 23/055 257/E23.19
6,843,680 B2 * 1/2005 Gorman ..... H01R 31/065 439/535
7,195,518 B2 * 3/2007 Bert ..... H01R 4/2441 439/290
7,316,584 B2 * 1/2008 Mackillop ..... H01R 13/6477 439/607.05
7,601,014 B2 * 10/2009 Wandler ..... H01R 13/53 439/181
7,604,505 B2 * 10/2009 Zayas ..... H01J 5/54 439/236
8,338,710 B2 * 12/2012 Maguire ..... H01R 11/284 174/135
8,545,275 B2 * 10/2013 Wang ..... H01R 13/44 439/680
8,591,257 B2 * 11/2013 Girard ..... H01R 13/6473 439/607.07
8,591,268 B2 * 11/2013 Reimchen ..... H01R 9/03 439/689
8,827,741 B2 * 9/2014 Johnson ..... H01R 13/518 439/541.5
8,926,366 B2 * 1/2015 Dang ..... H01R 13/6585 439/607.05
9,236,688 B2 * 1/2016 Friedhof ..... H01R 13/6461
2004/0018759 A1 1/2004 Wu
2006/0094292 A1 5/2006 Shindo
2006/0246780 A1 11/2006 Bert et al.
2007/0259568 A1 11/2007 Mackillop et al.
2015/0311631 A1 * 10/2015 Bernardi ..... H01R 13/631 439/660

* cited by examiner

HIGH-SPEED ELECTRICAL CONNECTOR

RELATED APPLICATION

This application is a national phase of PCT/FR2013/051935, filed Aug. 13, 2013, which claims priority to FR1257852, filed Aug. 17, 2012. The contents of those applications are hereby incorporated by reference.

BACKGROUND OF THE INVENTION

Field of the Invention

The invention relates to a high-speed electrical connector, e.g. suitable for conveying "Ethernet" signals at a rate of about 10 gigabits per second. The invention relates more particularly to an improvement seeking to better conserve the characteristic impedance of a twisted pair of insulated electrical conductors.

A high-speed shielded connector is known that comprises at least one pair of connection elements of male or female type, said connection elements being parallel and installed in a cavity of oblong section having a metal wall forming shielding. The cavity houses an insert made of insulating material, of high dielectric constant, and forming a support for said connection elements.

When such a connector is a plug, it is for connecting to a data transmission cable having at least one pair of conductors that are twisted together. The conductors are surrounded by metal shielding. Two similar connectors may be connected to the ends of a cable having at least one such pair of conductors. The connector may also be in the form of an appliance inlet or outlet suitable for mounting on a support of an electronic appliance (e.g. on a wall of the housing of the appliance) in order to receive a plug-forming connector of the same type.

In this type of connector, it is common practice to have four pairs of connection elements connected to four conductor pairs. Each pair is surrounded by metal electromagnetic shielding. A line having such connectors thus has four high-speed data transmission channels. Overall outer shielding, both for the connector and for the cable, then protects the line(s) from external electromagnetic disturbances while the individual shielding on each of the twisted conductor pairs reduces crosstalk between the channels. U.S. Pat. No. 7,316,584 describes a connector of that kind.

SUMMARY OF THE INVENTION

In order to further increase the performance of such equipment, it is desirable to ensure that the characteristic impedance of the transmission line is well conserved, in particular at the intersection between two connectors that are connected together end-to-end. Good conservation of characteristic impedance all along the cabling serves to optimize the transmission of power between a transmitter and a receiver. In particular, the impedance of the receiver must be equal to the characteristic impedance of the line in order to avoid reflections. Local impedance mismatches can give rise to the appearance of standing wave phenomena that lead to transmission loses.

The invention enables this problem to be solved.

More particularly, the invention provides a high-speed connector comprising at least one pair of connection elements of male or female type that are parallel and installed in an insert of insulating material forming a support for said connection elements, each of said connection elements of said pair being electrically connected to an electrical conductor of a twisted pair, the connector being characterized in that the end portion of said insert is shaped to define a baffle between the two connection elements, which baffle is suitable for imparting dielectric contact to the abutment interface between said insert and another insert that is similar and forms part of another connector, thereby establishing dielectric continuity at said abutment interface.

In particular, the insert may be installed in a metal-walled cavity forming electromagnetic shielding. Said twisted pair may also be covered in a flexible metal sheath forming electromagnetic shielding. It is thus possible to provide continuity of the electromagnetic shielding around the pair of connection elements and beyond them.

In an element, the connector is characterized in that the end of said insert includes a tooth projecting along a direction parallel to a direction of said connection elements, and an adjacent notch that is parallel and that opens out at the root of said tooth, the tooth and the notch being substantially identical in shape and dimensions so as to co-operate respectively with a similar notch and a similar tooth of said other insert.

Impedance matching is thus conserved at the connection between the male and female connection elements belonging to the two connectors, since there is no longer any sudden break in the characteristics of the insulation at the interface. In particular, the sheet of air that remains in prior art devices between the ends of the two inserts is eliminated by the inserts contacting each other via the baffle.

In other words, the two inserts are in contact and interpenetrate over a certain length, thereby limiting variations of impedance in the connection zone.

BRIEF DESCRIPTION OF THE DRAWINGS

The invention can be understood and other characteristics thereof appear more clearly in the light of the following description of an embodiment of a connector in accordance with the principle of the invention and given solely by way of example and with reference to the accompanying drawings, in which.

DETAILED DESCRIPTION OF THE INVENTION

Figure 1:
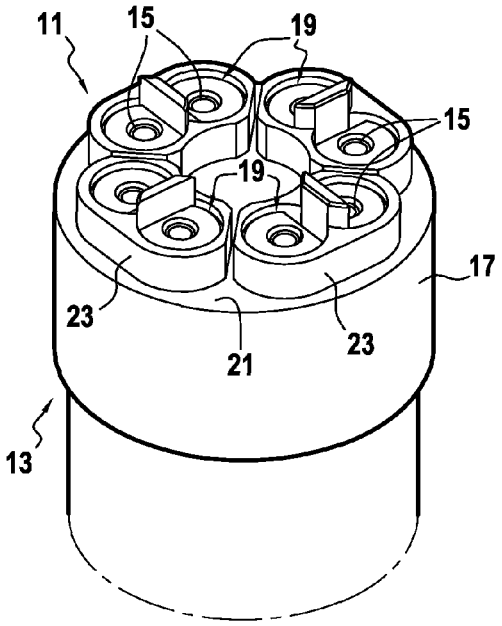
FIG. 1 is a fragmentary perspective view of the end of a connector in accordance with the invention.

In FIG. 1, there can be seen the front face 11 of a high speed connector 13, specifically a portion of a socket-outlet, carrying female type connection elements. Other elements of the connector that are conventional are not shown, for example the elements that form part of external shielding surrounding the subassembly shown. FIG. 1 shows a body 17, which in this example has defined therein four longitudinally-extending cavities 19. In this example, each cavity is of oblong section and houses a pair of connection elements 15, the elements shown being of the female type. The walls of these cavities are at least metal-plated in order to provide electromagnetic shielding of the connection elements they contain. In the example, the body 17 as a whole is made of metal. The invention is applicable regardless of the number of cavities. In the example, the arrangement is conventional with four cavities 19 that are regularly spaced apart circumferentially in the body 17, which is generally cylindrical in shape. Beyond a base surface 21 of circular outline of the body 17, each cavity 19 is extended by a shielding skirt 23 suitable for coming into contact with a similar shielding skirt 23*a* of larger size belonging to another connector 13*a* (see FIG. 4) in order to provide continuity of electromagnetic shielding with that other connector, which other connector is provided with male type connection elements 15*a* in this example. The shielding skirt 23*a* slides outside the shielding skirt 23 of the connector 13 carrying the female type connection element 15.

Figure 2:
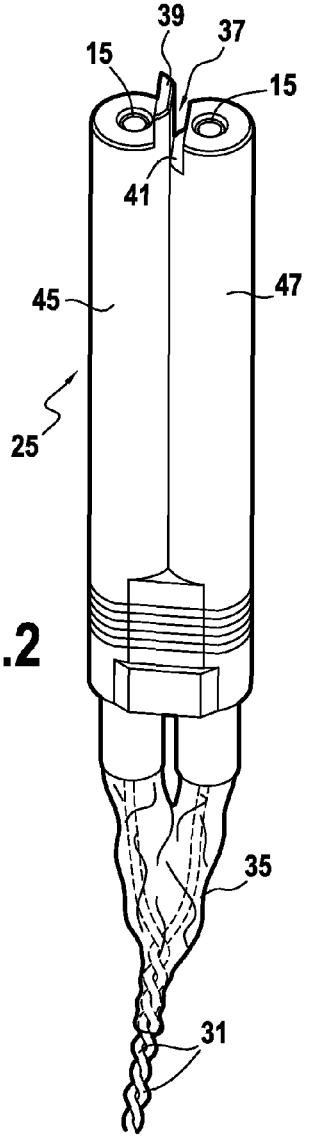
FIG. 2 is a detail view on a larger scale of an insert forming the support for two connection elements.
Figure 3:
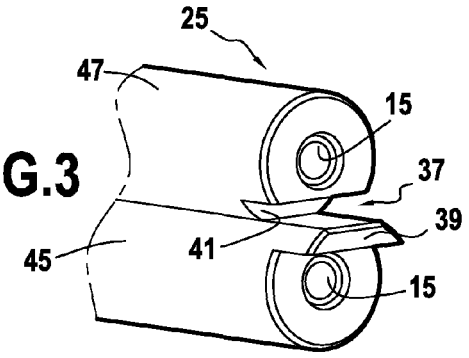
FIG. 3 is a view on a larger scale of the end of the insert.

Each cavity 19 houses an insert 25 made of insulating material. The characteristics of the insulating material are predetermined as a function of the characteristic impedance that is to be conserved. The insert 25 forms the support for two connection elements 15. In FIGS. 1 and 2, it can be seen that each female type connection element is housed in a duct 27 of the insert. The arrangement is similar for connection elements of male type. The two ducts are parallel, and consequently the two connection elements are parallel and spaced apart by a predetermined distance. Each connector element, of the female type in this example, has a tubular portion with an open end situated in the vicinity of an orifice of the corresponding duct 27 of the insert 25.

At the other end of the insert 25, two insulated conductors 31 are electrically connected respectively to the two connection elements 15. They are twisted together beyond the ducts 27 of the insert and the assembly of each twisted pair of conductors is covered in a flexible metal sheath 35 forming shielding for reducing crosstalk with other conductor pairs connected to the same connector.

Figure 4:
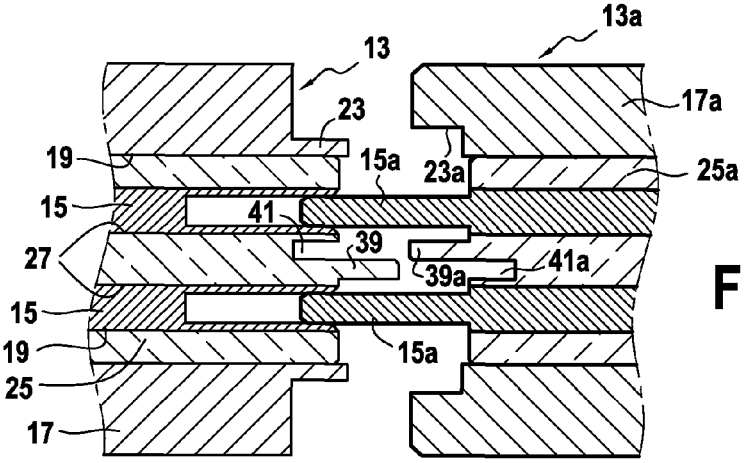
FIGS. 4 to 6 are fragmentary longitudinal section views showing how two inserts belonging to two similar complementary connectors co-operate, which connectors are respectively fitted with male and with female connection elements.

In FIG. 4, there can be seen the same insert 25 fitted with two female type connection elements 15 and belonging to the same connector 13. Another insert 25*a* that is similar and that contains male type connection elements 15*a* in the form of pins can also be seen in FIG. 4. The pins engage in the female type connection elements 15. As shown, the other insert 25*a* is installed in another metal body 17*a* forming part of another connector 13*a* in accordance with the invention. The shielding skirt 23*a* of the cavity of this insert 25*a* is visible in FIG. 4, and its inside surface is in sliding contact with the outside surface of the corresponding shielding skirt 23 forming part of the connector 13.

Figure 5:
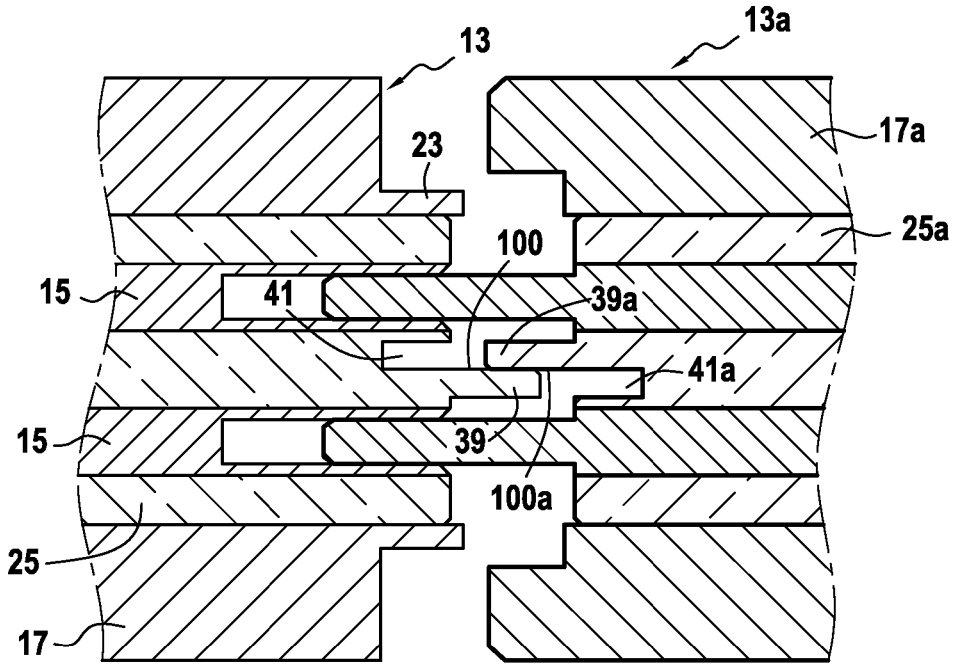
Figure 6:
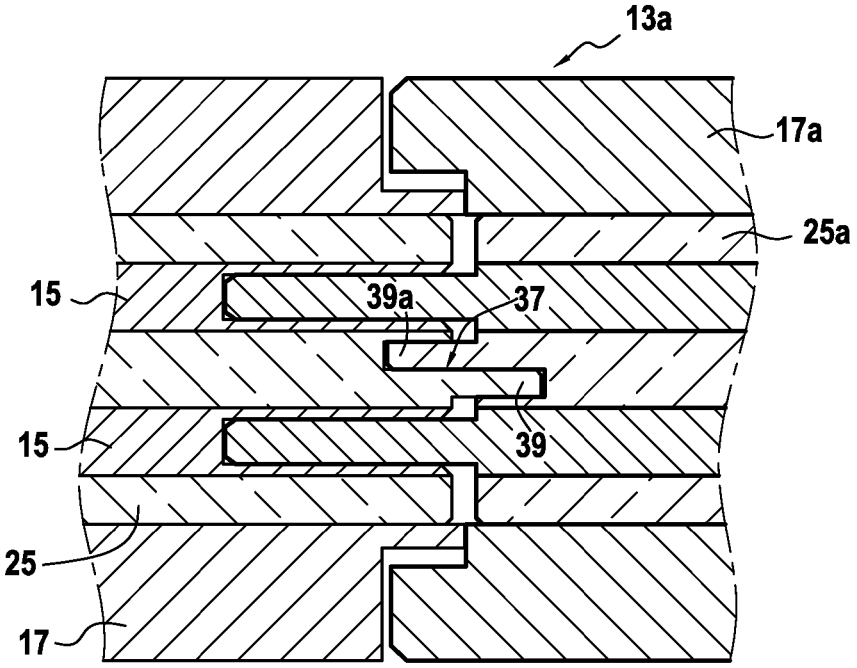

According to an important characteristic of the invention, the end portion of the insert 25 is shaped to define a baffle 37 providing dielectric contact at the abutment interface between said insert 25 and the other, similar insert 25*a* forming part of another connector 13*a*, as shown in FIGS. 5 and 6. The baffle 37 is situated between the two connection elements 15. Dielectric continuity is thus conserved at this abutment interface, in particular by the fact that the walls of the two inserts defining the baffle are in effective mechanical contact, preferably over at least the major portion of their surface areas.

In the example shown, the end of said insert includes a tooth 39 between the two connection elements, which tooth 39 projects in a direction parallel to that of the connection elements, and is adjacent to a notch 41 that is parallel and that opens out at the root of said tooth. The tooth 39 and the notch 41 are substantially identical in shape and dimensions so as to co-operate respectively with a notch 41*a* and a tooth 39*a* that are similar, forming parts of another insert 25*a* belonging to the other connector 13*a* and containing the pair of male type connection elements 15*a*, as can be seen in FIG. 4.

In FIG. 5, the connectors 13 and 13*a* are shown in a closer-together position during the operation of connecting the connectors 13 and 13*a* together. Thus, in this figure, it can be seen how a side surface 100 of the tooth 39 that projects into the notch 41 comes into contact with a corresponding side surface 100*a* of the tooth 39*a*. The inserts 25 and 25*a* are configured so that the surfaces 100 and 100*a* exert sideways pressure against each other, in particular in the final position shown in FIG. 6, in which these surfaces 100 and 100*a* form a central segment of the baffle 37 so as to ensure dielectric continuity between the inserts.

Since the teeth 39, 39*a* and the notches 41, 41*a* are of dimensions that are substantially equal, the assemblies formed by a tooth 39, 39*a* and a notch 41, 41*a* of each insert 25, 25*a* can be considered as being hermaphrodite. The hermaphrodite nature of these two-notched assemblies makes it possible to use substantially identical inserts 25, 25*a* for both connectors 13, 13*a*, thereby reducing production costs. Naturally, an insert containing female type connection elements needs to be brought into abutment with an insert containing male type connector elements, and vice versa. A connector in accordance with the invention can thus contain pairs of male connection elements or pairs of female connection elements. It is also possible for it to contain both pairs of male connection elements and pairs of female connection elements.

As can be seen more particularly in FIG. 2, said insert 25 has two substantially cylindrical segments 45 and 47 that are longitudinally side by side. The tooth 39 extends the side of one of the segments while the notch 41 extends into the side of the end portion of the other segment.

The insert 25 is made as a single piece.

As mentioned above, the connector may constitute a plug connected to a cord containing the various electrically insulated conductors. It may also constitute a socket suitable for being mounted on a support of any electronic appliance.

The invention claimed is:

1. A high-speed connector comprising:

at least one pair of connection elements of male or female type that are parallel and installed in an insert of insulating material forming a support for said connection elements, each of said connection elements of said pair being electrically connected to an electrical conductor of a twisted pair, wherein an end portion of said insert is shaped to define a baffle between the two connection elements, which baffle is suitable for imparting dielectric contact to the abutment interface between said insert and another insert that is similar and forms part of another connector, thereby establishing dielectric continuity at said abutment interface, wherein the end portion of said insert includes a tooth projecting along a direction parallel to a direction of said connection elements, and an adjacent notch that is parallel and that opens out at the root of said tooth, the tooth and the notch being substantially identical in shape and dimensions so as to co-operate respectively with a similar notch and a similar tooth of said other insert, and wherein said insert comprises two substantially cylindrical segments that are side by side, in that the tooth extends from a side of one of the segments, and said notch extends into the end portion of the other segment along a side of the other segment.

2. A connector according to claim 1, wherein said insert is installed in a metal-walled cavity providing electromagnetic shielding.

3. A connector according to claim 1, wherein said twisted pair is covered in a flexible metal sheath forming electromagnetic shielding.

4. A connector according to claim 1, wherein the connector includes four pairs of connection elements.

5. A connector according to claim 4, wherein each of said pairs of connection elements is connected to a corresponding twisted pair.

6. A connector according to claim 1, forming a socket suitable for being mounted on a support of an electronic appliance.

7. A connector according to claim 1, forming a plug.

* * * * *